US010024133B2

(12) United States Patent
Symms

(10) Patent No.: US 10,024,133 B2
(45) Date of Patent: Jul. 17, 2018

(54) ELECTRONICALLY-ACTUATED, MULTI-SET STRADDLE BOREHOLE TREATMENT APPARATUS

(71) Applicant: Weatherford/Lamb, Inc., Houston, TX (US)

(72) Inventor: Joshua V. Symms, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 921 days.

(21) Appl. No.: 13/952,001

(22) Filed: Jul. 26, 2013

(65) Prior Publication Data

US 2015/0027724 A1 Jan. 29, 2015

(51) Int. Cl.

| | |
|---|---|
| ***E21B 34/12*** | (2006.01) |
| ***E21B 33/128*** | (2006.01) |
| ***E21B 23/06*** | (2006.01) |
| ***E21B 33/124*** | (2006.01) |
| ***E21B 34/14*** | (2006.01) |
| *E21B 34/16* | (2006.01) |

(52) U.S. Cl.

CPC ..... *E21B 33/1285* (2013.01); *E21B 23/06* (2013.01); *E21B 33/1243* (2013.01); *E21B 34/14* (2013.01); *E21B 34/16* (2013.01)

(58) Field of Classification Search

CPC ..... E21B 33/1285; E21B 34/14; E21B 34/066
See application file for complete search history.

(56) References Cited

U.S. PATENT DOCUMENTS

| | | | |
|---|---|---|---|
| 4,962,815 | A | 10/1990 | Schultz et al. |
| 5,295,393 | A | 3/1994 | Thiercelin |
| 6,655,461 | B2 | 12/2003 | Eslinger et al. |
| 6,915,848 | B2 | 7/2005 | Thomeer et al. |

(Continued)

FOREIGN PATENT DOCUMENTS

| | | | |
|---|---|---|---|
| WO | 2010054407 | 5/2010 | |
| WO | WO 2010/149643 A1 * | 12/2010 | ..... E21B 33/124 |
| WO | 2012068672 A1 | 5/2012 | |

OTHER PUBLICATIONS

European Search Report and Opinion in counterpart EP Appl. 14176852, dated Dec. 17, 2014.

(Continued)

*Primary Examiner* — D. Andrews
*Assistant Examiner* — Kristyn A Hall
(74) *Attorney, Agent, or Firm* — Blank Rome LLP

(57) ABSTRACT

A straddle apparatus deploys in a borehole with tubing to treat different formation zones. The apparatus has packer elements and a flow element. The packer elements have fill ports in fluid communication with the tubing and have packer valves. These packer valves are biased to open fluid communication between the elements and the fill port so the elements can be inflated to seal off a borehole section. The flow unit has a flow port in fluid communication with the tubing and has a flow valve biased to close fluid communication between the flow port and the borehole. Once the elements inflate, a control unit electronically activate the packer valves to close fluid communication between the elements and the fill ports. Then, the control units electronically activates the flow valve to open fluid communication between the flow port and the borehole so treatment can be applied to the formation zone.

32 Claims, 11 Drawing Sheets

(56) References Cited

U.S. PATENT DOCUMENTS

| | | | | |
|---|---|---|---|---|
| 7,472,746 | B2 | 1/2009 | Maier | |
| 7,836,962 | B2 | 11/2010 | Fagley, IV et al. | |
| 8,286,717 | B2 | 10/2012 | Giroux et al. | |
| 2007/0285275 | A1 | 12/2007 | Purkis et al. | |
| 2008/0000635 | A1* | 1/2008 | Rioufol | E21B 23/00 166/250.17 |
| 2009/0044937 | A1 | 2/2009 | Purkis | |
| 2009/0223663 | A1 | 9/2009 | Snider et al. | |
| 2009/0266544 | A1 | 10/2009 | Redlinger et al. | |
| 2010/0200243 | A1 | 8/2010 | Purkis | |
| 2010/0200244 | A1 | 8/2010 | Purkis | |
| 2011/0248566 | A1 | 10/2011 | Purkis | |
| 2011/0290504 | A1 | 12/2011 | Purkis | |
| 2012/0160524 | A1 | 6/2012 | Lumbye | |
| 2012/0181044 | A1* | 7/2012 | Nikiforuk | E21B 7/20 166/374 |
| 2012/0273225 | A1 | 11/2012 | Logiudice et al. | |
| 2013/0161100 | A1* | 6/2013 | Zhou | E21B 7/00 175/230 |

OTHER PUBLICATIONS

Weatherford, "Inflatable Products and Accessories," obtained from www.weatherford.com, (c) 2008-2010, brochure No. 612.02, 96 pages.

"Special Focus: Drilling Technology—Improving underreaming reliability with RFID technology," originally appeared in World Oil, Apr. 2012 issue, pp. 51-63, article copyright (c) 2012 by Gulf Publishing Company.

"Rooted in Technology," Weatherford Magazine, Mar. 2013 vol. 15 No. 1, a Weatherford client publication, (c) 2013, 40 pages.

Weatherford, "RipTide Drilling Reamer," obtained from www.weatherford.com, (c) 2004-2012 brochure No. 7038.03.

"TAM-J Multiple Set Inflatable Packer System," ISO 9001 : 2008 Certified Company, TAM International, Inc. Feb. 11, obtained from www.tamintl.com, 8 pages.

* cited by examiner

ELECTRONICALLY-ACTUATED, MULTI-SET STRADDLE BOREHOLE TREATMENT APPARATUS

BACKGROUND OF THE DISCLOSURE

Inflatable production packers are inflated by opening a spring-compressed poppet valve that allows fluid to inflate the packer element. When the preferred pressure is reached, the poppet valve closes and traps the inflation pressure within the element. Deflating the element depends on the particular mechanical design of the packer. For example, the packer may use a rotate-release system in which the workstring is pulled up and rotated to deflate the element. In contrast, a pull-release system requires the workstring to be pulled up with an appropriate force to shear releasing pins so the element can be deflated.

A straddle packer injection tool has inflatable straddle packers to isolate a section of a borehole downhole so fluid treatment can be applied. This tool requires manipulation of the tubing/drill pipe to function—i.e., to inflate the packing elements, lock in the element pressure, open frac ports, close the frac ports, and deflate the elements. When the tool is to be set multiple times downhole, the tool needs to revert back to an initial condition so it can be set again. As expected, functioning this tool multiple times downhole can be challenging.

The subject matter of the present disclosure is directed to overcoming, or at least reducing the effects of, one or more of the problems set forth above.

SUMMARY OF THE DISCLOSURE

A straddle fluid treatment apparatus deploys in a borehole with tubing to treat sections of the borehole with fracture treatment or other type of treatment. The apparatus has first and second packers disposed on the apparatus. Each of the packers can have a fill port in fluid communication with the tubing and can have a packer valve biased to open fluid communication between the packers and the fill port. Disposed between the first and second packers, the apparatus has a flow unit having a flow port in fluid communication with the tubing, and a flow valve of the flow unit is biased to close fluid communication between the flow port and the borehole.

Finally, one or more control units on the apparatus are operatively coupled to the packer valves and the flow valves. The control units operate the valves based on at least one detected activation with instructions conveyed downhole to the apparatus. For example, an RFID system can be used to send and receive instructions via RFID tag(s) to the one or more control units to configure operation of the apparatus.

During run-in, the packer valves can be open, and the flow valve can be closed. Once the apparatus reaches a section of the borehole to be treated, fluid flow through the tubing string beyond the lowermost packer is closed off. For example, an isolation valve on the tubing string is closed by any of a number of techniques, such as by a plug dropped to close off the valve or by other methods. The packer valves are then opened (if not already), and pressure pumped down the tubing string enters the packers through the open packer valves to set the packers and seal off the section of the borehole.

In one embodiment, one or both of the packers are inflatable packers having an inflatable packer element that inflates with the pressure communicated down the tubing. In another embodiment, one or both of the packers are compressible packers having a compressible packer element that is compressed with the pressure communicated down the tubing.

Eventually, the one or more control units electronically activate the packer valves to close fluid communication between the packers and the fill ports so that the pressure is trapped in the packers' setting mechanisms. For example, pressure can be trapped in an inflatable element of an inflatable packer, or pressure can be trapped in a piston chamber of a compressible packer. In one implementation, this activation can occur after a set period of time after passage of an initial RFID tag, which may be associated with a plug dropped to close off the tubing string or associated with some other action.

Meanwhile, the one or more control units electronically activate the flow valve to open fluid communication between the flow port and the borehole. This may also be timed after passage of the initial RFID tag. At this point, treatment pumped down the tubing string can flow out the open flow port and into the isolated borehole section to treat the formation or the like.

Eventually, the flow port can be closed, and the packer valves can be opened to unset the packers (e.g., deflate the inflatable packers or release the pistons of the compressible packers). These operations can be initiated in a number of ways. In one example, the closing of the flow valve and the reopening of the packer valves can be timed to a set period of time after the passage of the initial RFID tag. Alternatively, a new RFID tag can be deployed down the tubing string in the flow used during the treatment through the flow port. This new RFID tag can be detected by the one or more control units on the apparatus to initiate closing of the flow valve and opening of the packer valves.

Still further, activation of this second stage can use another type of system different than the RFID system used with the initial RFID tag. In this case, the one or more control units on the apparatus may have multiple means for receiving instructions. In the end, circulation through the tubing string may be restored by opening the downhole isolation valve (e.g., the previously dropped plug can be floated to the surface, the valve can be electronically activated, or some other operation can be performed) to reopen flow through tubing string. With the isolation valve opened, the tubing string can be moved to a new section of the borehole so isolation, pack-off, and treatment can be repeated.

The foregoing summary is not intended to summarize each potential embodiment or every aspect of the present disclosure.

BRIEF DESCRIPTION OF THE DRAWINGS

FIGS. 2B-1 and 2B-2 illustrate components of a compression-set packer for the disclosed straddle apparatus in unset and set conditions, respectively.

DETAILED DESCRIPTION OF THE DISCLOSURE

Figure 1A:
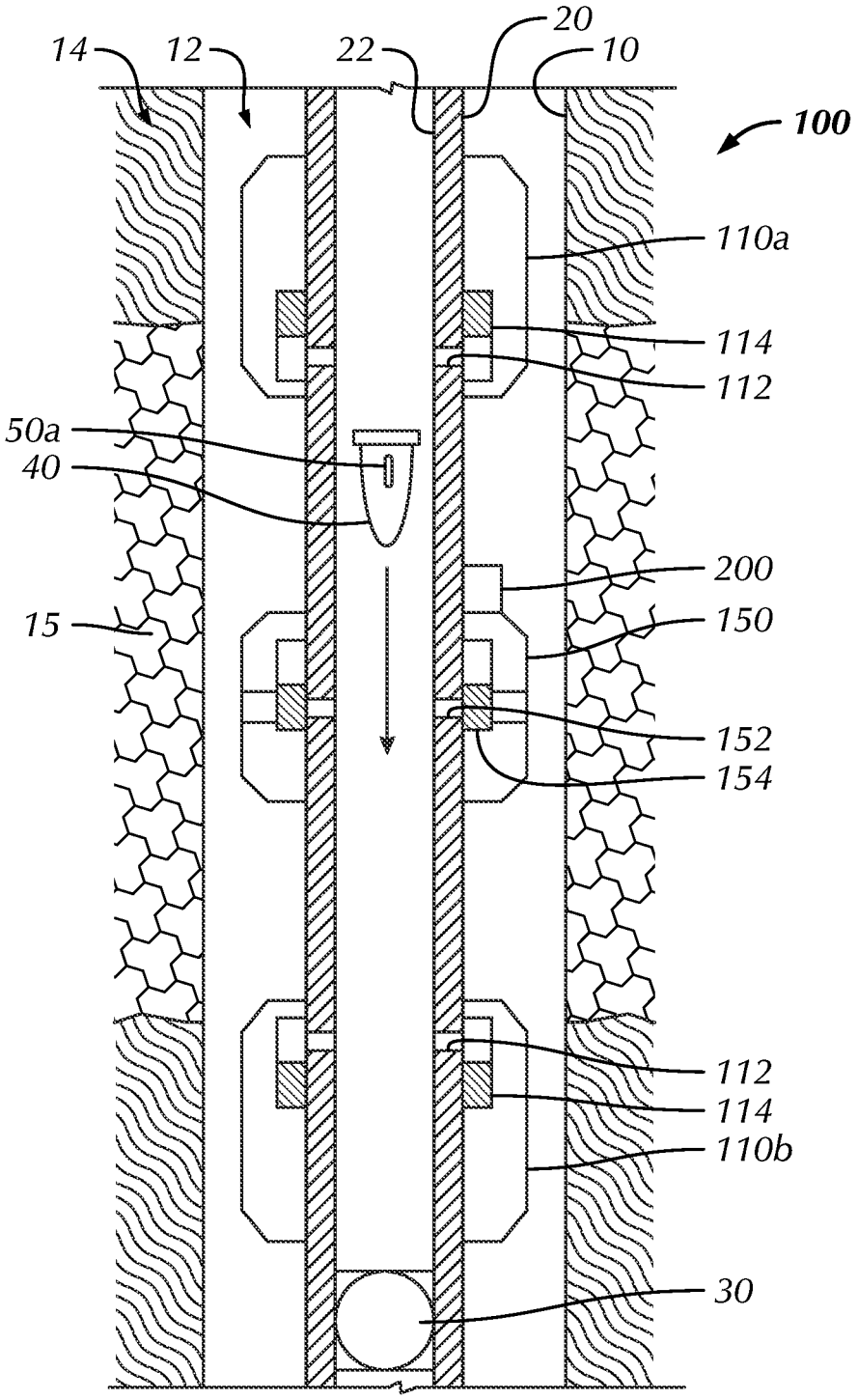
FIG. 1A illustrates a tubing string having an electronically-actuated, multi-set straddle apparatus according to the present disclosure in a run-in condition.

FIG. 1A illustrates a tubing string or drill pipe 20 having an electronically-actuated, multi-set straddle apparatus 100 according to the present disclosure in a run-in condition. The apparatus 100 includes straddle packers 110*a-b* disposed on each side of a flow port unit 150. The packers 110*a-b* and flow port unit 150 can be separate components with housings (not shown) coupled together on the tubing string 20, or they can be an integrated assembly coupled to the tubing string 20.

For run-in of the tubing string 20 into a borehole 10, the apparatus 100 is lowered with the tubing string 20 to a desired zone 15 in the formation 14 to be treated with fracture treatment or other known type of treatment, such as acidizing, fracture acidizing, carbonate treatment, acid treatment, solvent treatment, chemical treatment, matrix treatment, etc. During run-in the borehole 10, the packers 110*a-b* of the apparatus 100 are unset and can be in the open position, and the flow port unit 150 can be closed. In particular, packer valves 114 on the packers 110*a-b* can keep internal ports 112 opened, and a flow valve 154 on the flow port unit 150 can remain closed relative to an internal port 152. Alternatively, the packer valves 114 can be closed to prevent inadvertent setting.

Downhole of the apparatus 100, an isolation valve 30 can be opened during run-in. Once the apparatus 100 is in position, operators close the isolation valve 30 using any of a number of techniques. For example, operators can deploy a plug 40 (e.g., dart, ball, etc.) down the tubing string 20 to land in a seat of the isolation valve 30 below the bottom packer 110*b*. With the plug 40 seated, pressure applied down the tubing string or drill pipe 20 can be used to set the packers 110*a-b*.

Rather than an isolation valve 30, any other suitable type of tubing closure can be used. Moreover, closing off fluid communication in the isolation valve 30 can use techniques other than a dropped plug 40, which would need to be floated so the apparatus 100 can be moved to another zone. As expected, floating a dropped plug 40 may not be possible after fracture stimulation because proppant can fill portion of the apparatus 100 on top of the plug 40. Accordingly, other techniques can be used to control the opening and closing of the isolation valve 30.

In particular, the isolation valve 30 can be activated with any number of techniques—e.g., RFID tags in the flow stream may be used alone or with plugs; chemicals and/or radioactive tracers may be used in the flow stream; mud pressure pulses (if the system is closed chamber); mud pulses (if the system is actively flowing); etc. For example, the isolation valve 30 can have a radio frequency identification (RFID) reader, battery, and electronics and can open and close in response to passage of at least one RFID tag. As an alternative to RFID, for example, the controller 200 can be configured to receive mud pulses from the surface or may include an electromagnetic (EM) or an acoustic telemetry system, which includes a receiver or a transceiver (not shown). An example of an EM telemetry system is discussed in U.S. Pat. No. 6,736,210, which is hereby incorporated by reference in its entirety. In general, the isolation valve 30 can have other types of detectors or sensors, such as a pressure sensor, telemetry sensor, a Hall Effect sensor, a radioactive trace detector, a chemical detector, and the like.

Figure 1B:
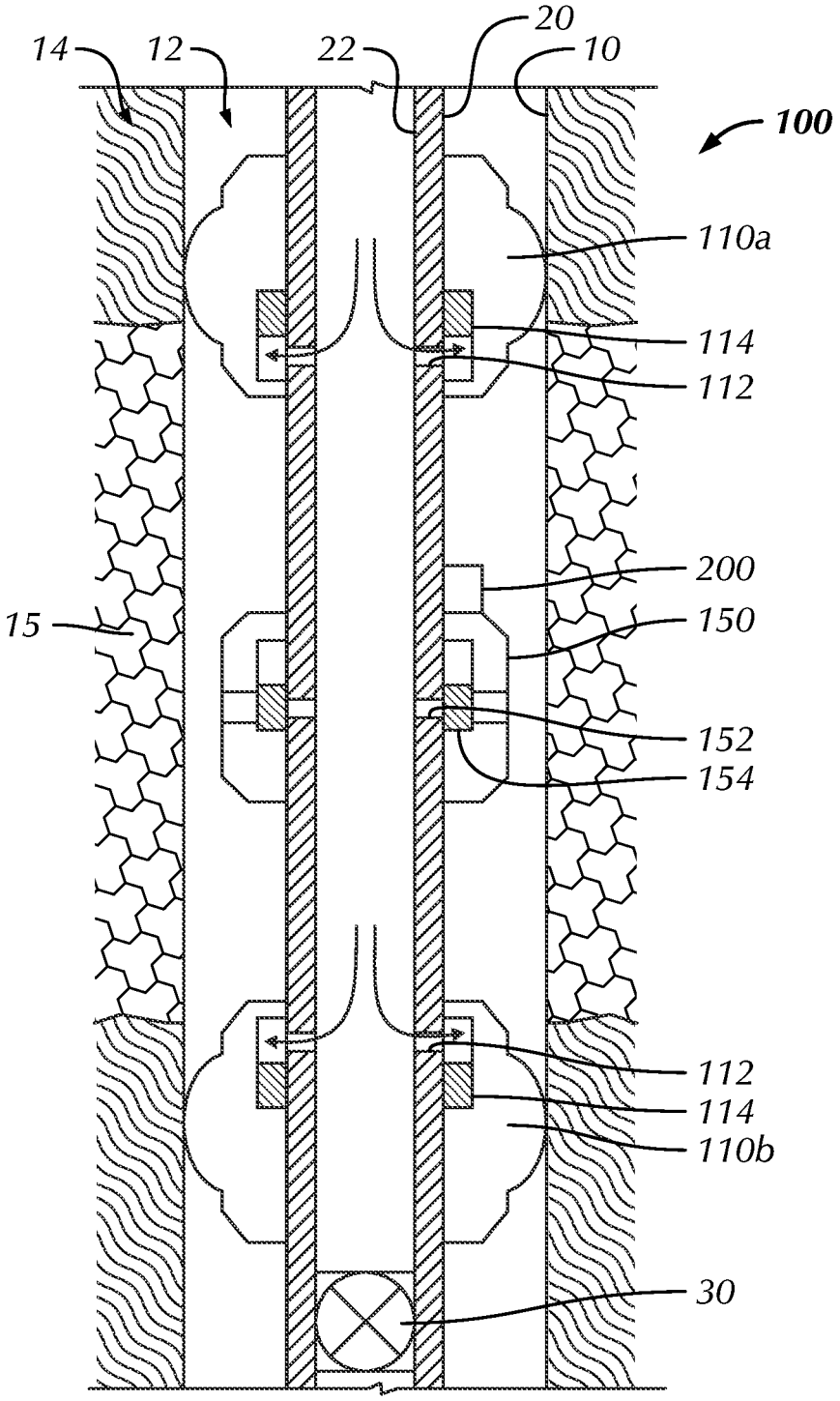
FIG. 1B illustrates the tubing string with the disclosed straddle apparatus in a partial set condition.

Turning to FIG. 1B, which shows the disclosed straddle apparatus 100 during part of the setting procedure of the packers 110*a-b*, fluid flow down the tubing string's bore 22 does not pass the closed isolation valve 30. Therefore, the fluid flows out the fill ports 112 and sets (e.g., inflates or compresses) the packers 110*a-b* to engage the surrounding borehole 10. This isolates the portion of the borehole annulus 12 between the packers 110*a-b*. Preferably, the packers 110*a-b* do not set until a certain desired pressure is reached to prevent premature setting during circulation when running in the hole. As further shown, each of the packers 110*a-b* may have its own fill ports 112, although this is not strictly necessary. Instead, the packers 110*a-b* can share one or more common fill ports 112 with adequate routing of flow in the apparatus 100 using techniques known in the art.

The plug 40 when deployed as in FIG. 1A can have a first tag 50*a* that passes one or more control units 200 downhole as the plug 40 is dropped from surface down the tubing string or drill pipe 20. Alternatively, the tag 50*a* can be conveyed alone or in another way. Either way, the tag 50*a* can be a Radio Frequency Identification (RFID) tag, although other types of devices and techniques can be used. If a plug 40 is not used (e.g., if the isolation valve 30 is RFID activated), then the tag 50*a* may be conveyed downhole all the same without the plug 40, but can be conveyed with some other object if necessary.

Downhole, the one or more control units 200 on the apparatus 100 use RFID technology to manipulate sleeves, valves, ports, or the like on the apparatus 100 to set and unset the packers 110*a-b* and to open and close the flow port unit 150 according to the procedures disclosed herein. To do this, the one or more control units 200 detect the tag 50*a* when it reaches the apparatus 100. In actuality, multiple tags 50*a* may be deployed for redundancy, with only one required to be detected to activate the apparatus 100.

After detecting the relevant first tag 50*a*, the one or more control units 200 on the apparatus 100 can open the packer valves 114 (if not already open) can then initiate a timer or delay before closing the fill ports 112 for the packers 110*a-b* and opening the flow port unit 150. The delay can be about 30-minutes or other amount of time sufficient so the pressure applied downhole can set (e.g., inflate or compress) the packers 110*a-b* as in FIG. 1B to a certain pressure given the hole size and casing ID. Once the delay expires and the packers 110*a-b* have been set to isolate the zone 15, the one or more control units 200 then electronically activate the packer valves 114 to close the fill ports 112 for the packers 110*a-b* and electronically activate the flow valve 154 to open the flow port unit 150 so treatment can be applied in the isolated portion of the annulus 12.

Figure 1C:
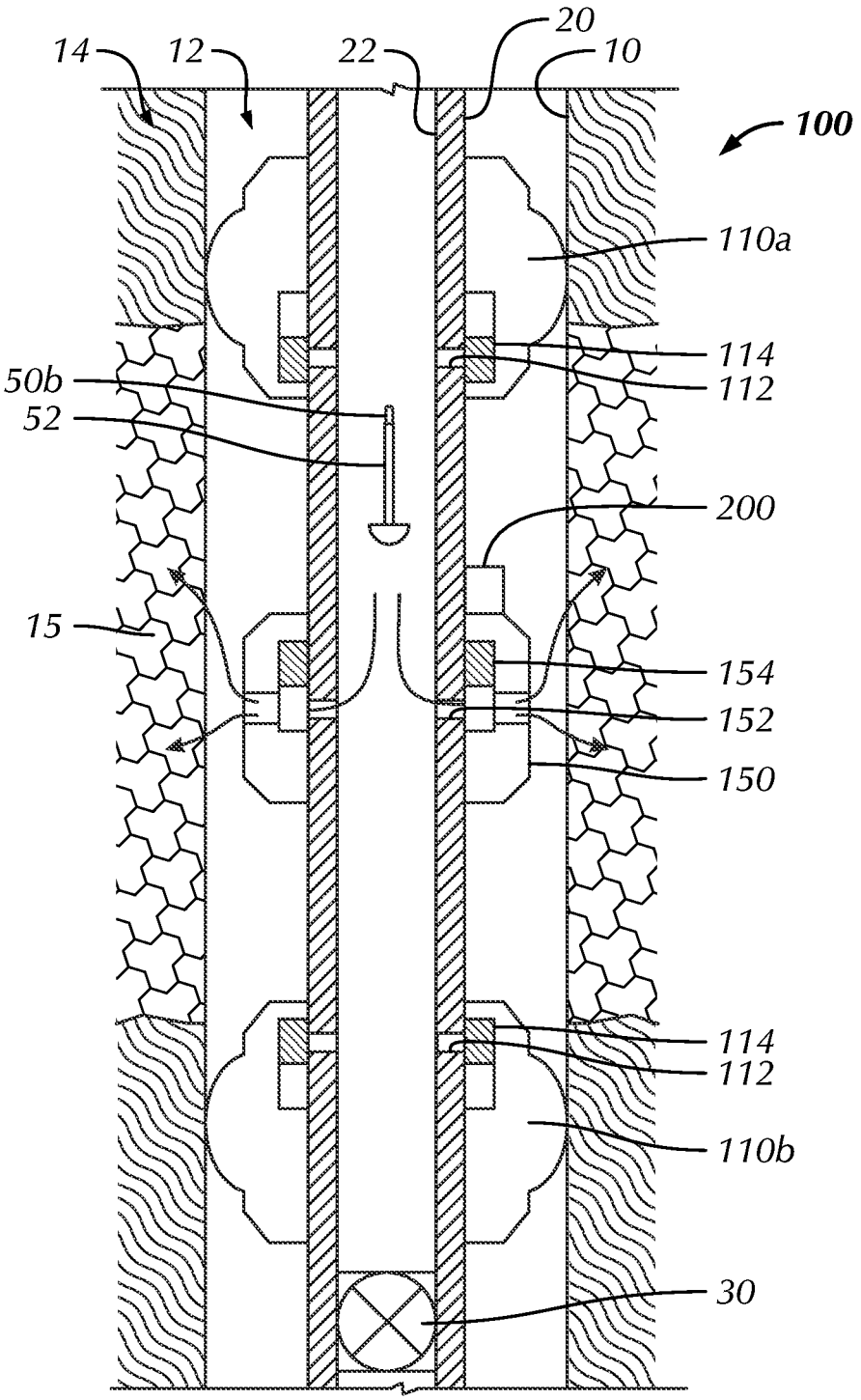
FIG. 1C illustrates the tubing string with the disclosed straddle apparatus in a set condition

FIG. 1C shows the disclosed straddle apparatus 100 during this set condition. In particular, after passage of the tag 50*a* and expiration of the timer, the valves 114 on the packers 110*a-b* are moved by the one or more control units 200 to close the internal ports 112. In one arrangement described in more detail below, one or more pumps of the one or more control units 200 turn on and push spring loaded sleeves to lock in element pressure for the packers 110*a-b*. The sleeves close off the ports 112 to prevent further pressure from entering the element of the packers 110*a-b* and to trap setting pressure in the packers' setting mechanisms.

Likewise, the one or more control units 200 open the flow valve 154 on the flow port unit 150 so that flow down the tubing string's bore 22 can flow out the flow ports 152 and treat the formation zone 15 between the set packers 110*a-b*. Thus, the flow valve 154 on the flow port unit 150 can also open in the same fashion as the packers 110*a-b*—e.g., utilizing pump(s) to shift a spring loaded sleeve. This activation on the flow unit 150 can also be delayed a certain amount of time after closing the packers' fill ports 112 to ensure that the setting and closing of the packers 110*a-b* is completed.

Once the flow port unit 150 opens as shown in FIG. 1C, treatment fluid, such as fracture proppant, acid, etc., can be pumped into the straddled area between the two packers 110*a-b*. When treatment nears completion, operators deploy another tag 50*b* down the tubing string 20 in the fluid flow. The one or more control units 200 on the apparatus 100 detect the second tag 50*b* when it reaches the apparatus 100 and electronically deactivate the packers 110*a-b* and close the flow port unit 150.

The operations initiated by this tag 50*b*, once it passes the one or more control units 200, may also be on a time delay. For example, the packers 110*a-b* may be opened to unset (e.g., deflate or uncompress) a certain period of time before the flow port unit 150 is opened. Moreover, instead of requiring the second tag 50*b* to be deployed to reset the apparatus 100, eventual unsetting of the packers 110*a-b* and closing of the flow port unit 150 may also be timed based on passage of the first tag 50*a*. In this case, deploying the second tag 50*b* may be unnecessary to revert the apparatus 100 to its run-in condition. In any event, use of a second tag 50*b* allows for independent deactivation of the apparatus 100 when desired, and may even be used as a backup if a timed operation fails.

Furthermore, the one or more control units 200 may be able to respond to other forms of communication similar to the details provided above with reference to the isolation valve 30. Accordingly, the one or more control units 200 can be activated with any number of techniques—e.g., RFID tags in the flow stream may be used alone or with plugs; chemicals and/or radioactive tracers may be used in the flow stream; mud pressure pulses (if the system is closed chamber); mud pulses (if the system is actively flowing); etc. These other forms of activation may be used as an alternative or as a backup to an RFID system as disclosed herein. In this way, opening and closing the packer valves 114 and flow valve 154 can use pressure pulses, telemetry, or any other disclosed technique, in addition to or as an alternative to the RFID system disclosed herein.

Figure 1D:
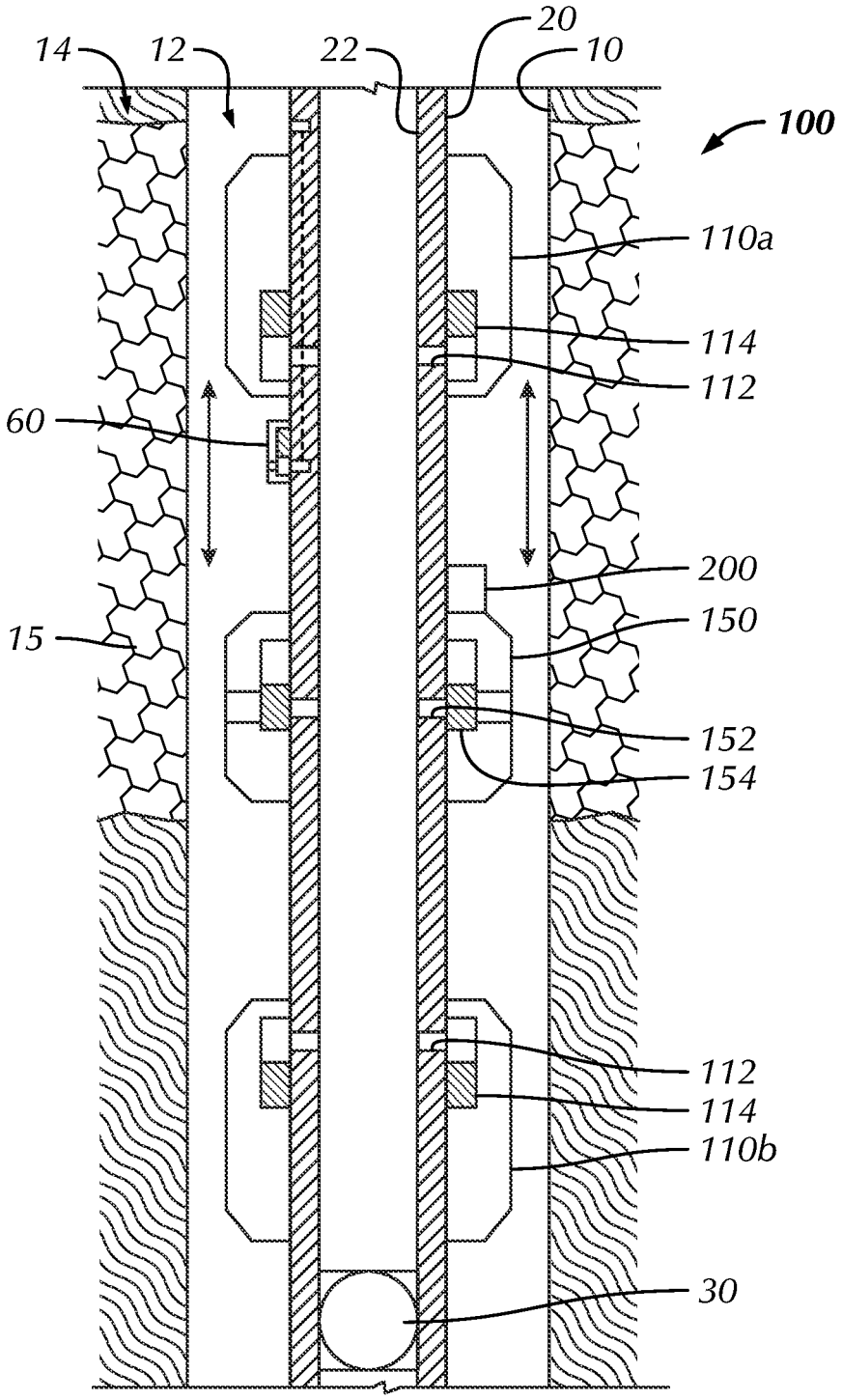
FIG. 1D illustrates the tubing string with the disclosed straddle apparatus in an unset condition.

FIG. 1D illustrates the tubing string 20 with the disclosed straddle apparatus 100 in an unset condition. The ports 112 of the packers 110*a-b* can be opened so the elements can unset (e.g., deflate or uncompress) and disengage from the borehole 10. Additionally, the flow port unit 150 closes. At this point, the isolation valve 30 can be opened using any of the various techniques disclosed herein. For example, the previously landed plug (40), if used, can be reverse circulated out of the valve 30 and floated to the surface. Finally, with the packers 110*a-b* unset, the tubing string 20 can be moved in the borehole 10 to position the apparatus 100 near another downhole zone to be treated.

As an option, it may be useful to include one or more actuatable valves (60: FIG. 1D) to selectively equalize pressure of the packed-off zone with the annulus prior to unsetting the packers 110*a-b*. These valves (60) can be actuated using any of the available techniques as disclosed herein and may be controlled by the one or more controllers 200. When opened, the isolated pressure between the set packers 110*a-b* is equalized with the annulus pressure above and/or below the packers 110*a-b* to facilitate unsetting the packers 110*a-b*.

As disclosed above with reference to FIG. 1A, operations can start by having the packer valves 114 initially open. This might not be desired in some instance. While running-in or moving between zones, the apparatus 100 may get stuck by material in the annulus. If this occurs, then it is normal to circulate fluid in order to dislodge the apparatus 100. Any pack-off occurring around the apparatus 100 can inhibit this circulation, and a differential pressure can build up that may start to set the packers 110*a-b*. Therefore, it may be desirable to only expose the packers 110*a-b* to pressure when they are going to be set.

To accomplish this, the one or more controllers 200 of the apparatus 100 can close the packers 110*a-b* when the apparatus 100 is being run-in and moved in the borehole, and the one or more controllers 200 can open the packers 110*a-b* when it is desirable to expose the packers 110*a-b* to pressure. Alternatively, the packer valves 114 may remain open during various stages of the operation, and the packer's setting mechanisms can be protected by additional valve mechanisms. For example, U.S. Pat. No. 7,836,962, which is incorporated herein by reference, discloses a pressure control valve mechanism that can limit the exposure of a packer's setting mechanism on the apparatus 100 to particular pressures. Thus, the packers 110*a-b* can have a separate piston assembly that is operable to control fluid communication between the fill ports 112 and the packers' setting mechanisms by closing off fluid communication therethrough above and/or below a certain pressure level.

In one embodiment as disclosed below with reference to FIGS. 2A-1 and 2A-2, one or both of the packers 110*a-b* can be an inflatable packer having an inflatable element that inflates with the pressure communicated down the tubing 20. In another embodiment as disclosed below with reference to FIGS. 2B-1 and 2B-2, one or both of the packers 110*a-b* can be a resettable compression-set packer having a compressible element that is compressed with the pressure communicated down the tubing.

Figures 1, 2A:
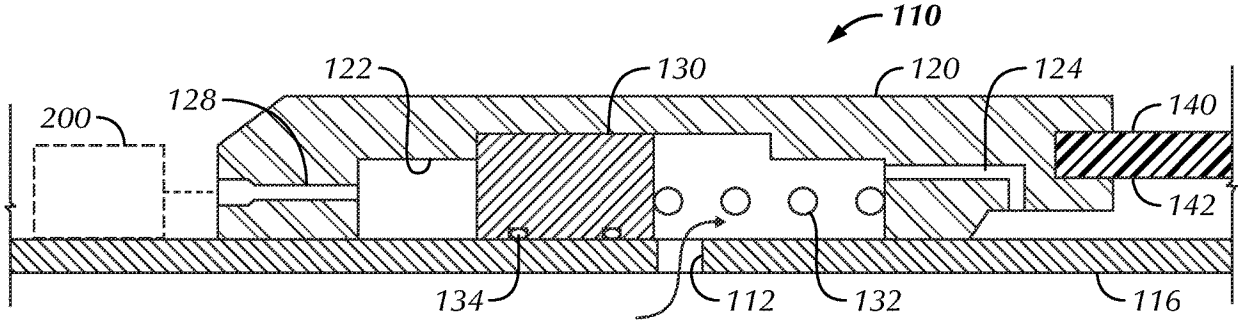
FIGS. 2A-1 and 2A-2 illustrate components of an inflatable packer for the disclosed straddle apparatus in unset and set conditions, respectively.
Figures 2, 2A:
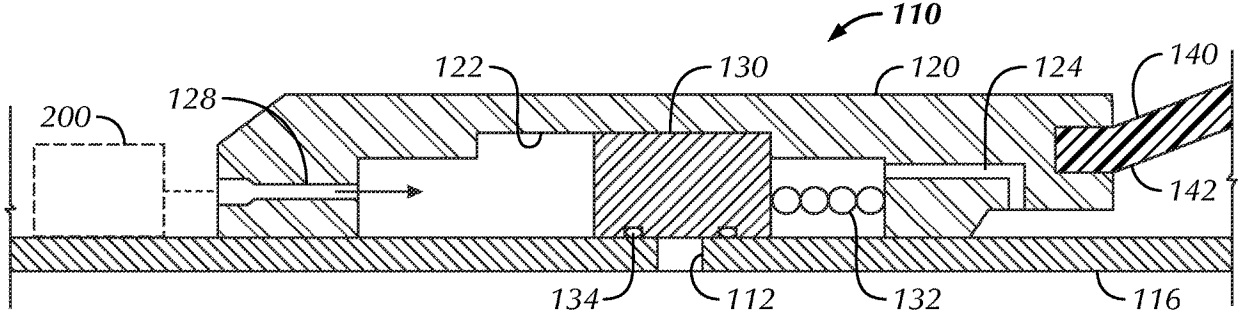

FIGS. 2A-1 and 2A-2 illustrate components of a packer 110 of the disclosed straddle apparatus (100) as an inflatable packer in unset and set conditions, respectively. The inflatable packer 110 includes a valve unit 120 disposed on a mandrel 116, which couples to or is part of the tubing string (20). A valve, piston, or sleeve 130 is movably disposed in a chamber 122 of the valve unit 120 between a closed condition (FIG. 2A-1) and an opened condition (FIG. 2A-2) relative to one or more internal ports 112 in the mandrel 116. Preferably, the valve 130 has the form of a cylindrical sleeve disposed concentrically on the mandrel 116 so multiple ports 112 can be isolated around the circumference of the mandrel 116. As such, the sleeve 130 forms the internal valve 114 of the packer 110 described previously.

Seals 134 (only some of which are shown) on the sleeve 130 can seal off the internal ports 112. The sleeve 130 is biased in the chamber 122 to the opened condition (FIG. 2A-1) by a biasing element 132, such as a spring or the like. As discussed in more detail later, force, pressure, or other counter bias from the one or more control units 200 moves the sleeve 130 against the bias of the biasing element 112 to close the sleeve 130 over the internal ports 112. In the absence of force, pressure, or other counter bias from the one or more control units 200, however, the biasing element 132 moves the sleeve 130 open so that flow of fluid can pass through the internal ports 112.

With the sleeve 130 open, the flow through the ports 112 can pass through a bypass channel 124 and fill a chamber 142 of an inflatable packer element 140. If desired, a separate piston assembly (not shown), as noted above, can be provided at such a bypass channel 124 to control fluid communication from the mandrel's port 112 to the packing mechanism (but not necessarily to control reverse communication) by closing off fluid communication therethrough above and/or below a certain pressure level. In this way, when the sleeve 130 is open, the packing mechanism (e.g., 140, 142, etc.) can be prevented from prematurely setting at a low pressure level and/or being over-exposed to high pressure levels during treatment.

The pressure from the filling fluid extends the inflatable element 140 to engage a surrounding borehole wall as noted herein. Details related to the filing and operation of an inflatable element on a packer are generally know so that they are not repeated here. Accordingly, various components related to the inflatable element 140 are omitted. It will be appreciated that the internal ports 112 of the packer 110 can include features to filter flow therethrough so proppant and other particulates do not enter components of the packer 110. In general, the ports 112 can use sets of slots dimensioned with respect to the particulate size expected in the operational fluid. Alternatively, the ports 112 can use screens or other types of particulate filtering mediums.

Eventually, as shown in FIG. 2A-2, when the one or more control units 200 are activated by the RFID tag (50), timer, or other method as discussed previously, pressure or bias from the one or more control units 200 applied in the chamber 122 through a channel 128 moves the sleeve 130 closed relative to the internal ports 112. Closing the sleeve 130 locks in the fluid pressure trapped in the chamber 142 of the inflatable element 140. To subsequently unset the packer 110, deactivation of the force, pressure, or counter bias from the one or more control units 200 allows the biasing element 132 to move the sleeve open 130 so pressure in the chamber 142 can be relieved and the element 140 can deflate during operations.

Figures 1, 2B:
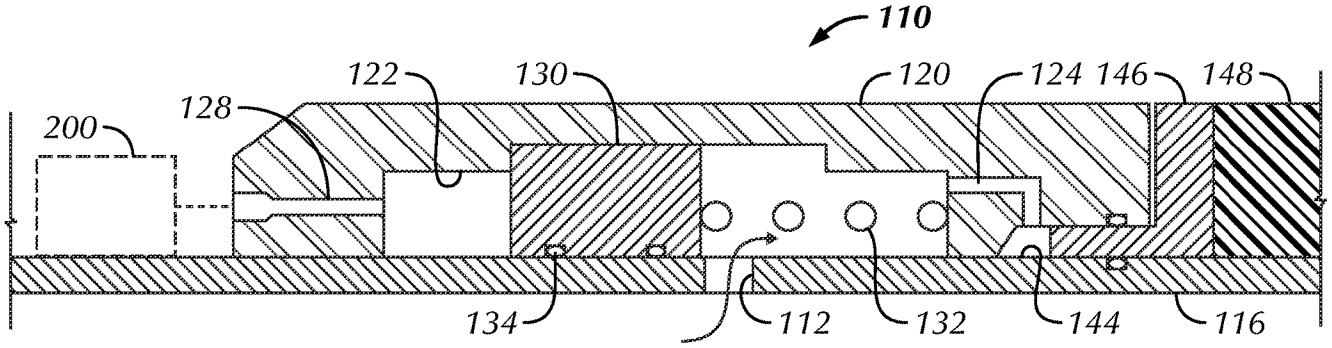
Figures 2, 2B:
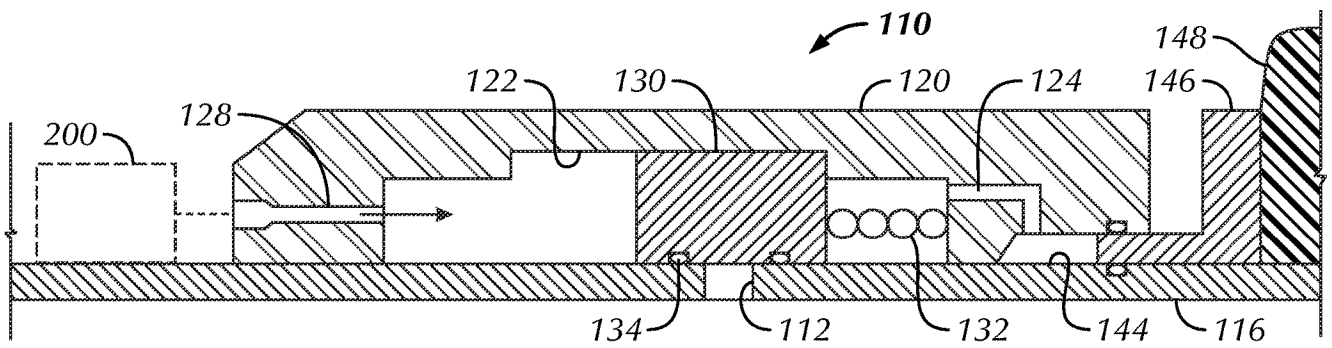

FIGS. 2B-1 and 2B-2 illustrate components of a packer 110 of the disclosed straddle apparatus (100) as a compression-set packer in unset and set conditions, respectively. As before, the packer 110 includes a valve unit 120 disposed on a mandrel 116, which couples to or is part of the tubing string (20). A valve, piston, or sleeve 130 is movably disposed in a chamber 122 of the valve unit 120 between a closed condition (FIG. 2B-1) and an opened condition (FIG. 2B-2) relative to one or more internal ports 112 in the mandrel 116. Preferably, the valve 130 has the form of a cylindrical sleeve disposed concentrically on the mandrel 116 so multiple ports 112 can be isolated around the circumference of the mandrel 116. As such, the sleeve 130 forms the internal valve 114 of the packer 110 described previously.

Seals 134 (only some of which are shown) on the sleeve 130 seal off the internal ports 112. The sleeve 130 is biased in the chamber 122 to the opened condition (FIG. 2B-1) by a biasing element 132, such as a spring or the like. As discussed in more detail later, pressure or other counter bias from the one or more control units 200 moves the sleeve 130 against the bias of the biasing element 112 to close the sleeve 130 over the internal ports 112. In the absence of pressure or other bias from the one or more control units 200, however, the biasing element 132 moves the sleeve 130 open so that flow of fluid can pass through the internal ports 112.

With the sleeve 130 open as in FIG. 2B-1, the flow through the ports 112 can pass through a bypass channel 124 and fill a chamber 144 of a piston element 146. If desired, a separate piston assembly (not shown), as noted above, can be provided at such a bypass channel 124 to control fluid communication between the mandrel's port 112 and the packing mechanism (but not necessarily to control reverse communication) by closing off fluid communication therethrough above and/or below a certain pressure level. In this way, when the sleeve 130 is open, the packing mechanism (e.g., 144, 146, 148, etc.) can be prevented from prematurely setting at a low pressure level and/or being over-exposed to high pressure levels during treatment.

The pressure from the filling fluid moves the piston element 146 to engage against a compressible packer element 148. As a result, the compressed packer element 148 compresses against a surrounding borehole wall as noted herein. Details related to the operation of a piston element 146 and a compressible packer element 148 are generally know so that they are not repeated here. Accordingly, various components related to the elements 146 and 148 are omitted.

Eventually, as shown in FIG. 2B-2, when the one or more control units 200 are activated by the RFID tag (50), timer, or other method as discussed previously, force, pressure, or counter bias from the one or more control units 200 applied in the chamber 122 through a channel 128 moves the sleeve 130 closed relative to the internal ports 112. Closing the sleeve 130 locks in the fluid pressure trapped in the piston chamber 144 of the piston element 146. To subsequently unset the packer 110, deactivation of the force, pressure, or counter bias from the one or more control units 200 allows the biasing element 132 to move the sleeve open 130 so pressure in the chamber 144 can be relieved and the compressible packer element 148 can uncompress during operations.

Figure 3A:
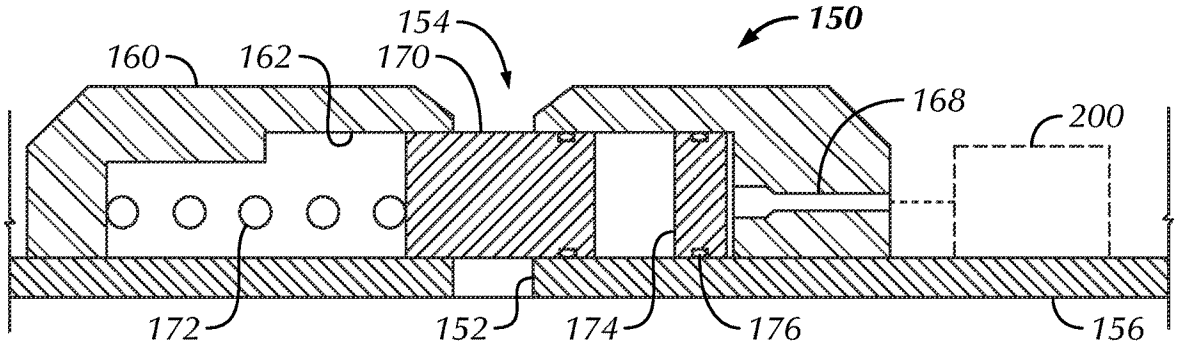
FIG. 3A illustrates components of a flow port unit for the disclosed straddle apparatus in a closed condition.
Figure 3B:
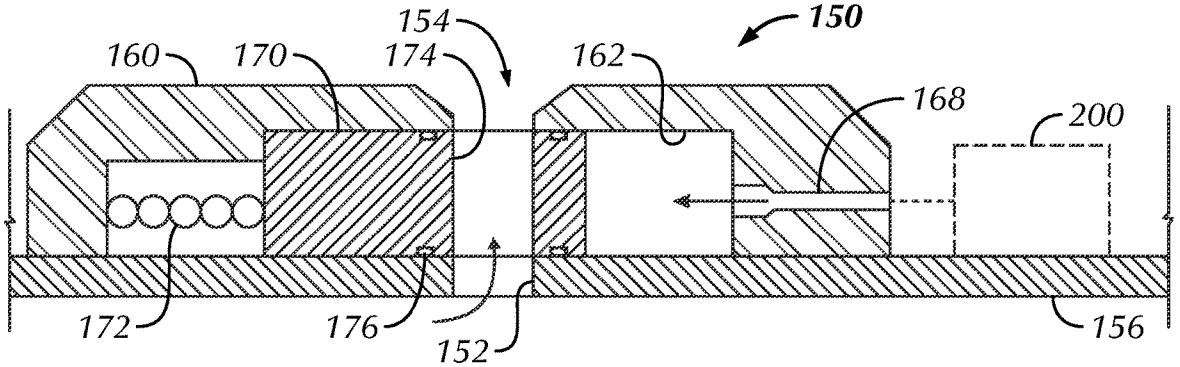
FIG. 3B illustrates components of the flow port unit for the disclosed straddle apparatus in an opened condition.

FIGS. 3A-3B illustrate components of a flow port unit 150 of the disclosed straddle apparatus (100) in closed and opened conditions, respectively. The flow port unit 150 includes a valve unit 160 disposed on a mandrel 156, which can be coupled to or part of the tubing string (20). A valve, piston, or sleeve 170 is movably disposed in a chamber 162 of the valve unit 160 between a closed condition (FIG. 3A) and an opened condition (FIG. 3B) relative to one or more internal ports 152 in the mandrel 156. Again, the valve 170 has the form of a cylindrical sleeve disposed concentrically on the mandrel 156 so multiple ports 152 can be isolated around the circumference of the mandrel 156. As such, the sleeve 170 forms the internal valve 154 of the flow port unit 150 described previously.

As before, seals 174 (only some of which are shown) on the sleeve 170 seal off the internal ports 152. The sleeve 170 is biased in the chamber 162 to the closed condition (FIG. 3A) by a biasing element 172, such as a spring or the like. As discussed in more detail later, pressure or other counter bias from the one or more control units 200 moves the sleeve 170 against the bias of the biasing element 172 to open the sleeve 170 relative to the internal ports 152. In the absence of pressure or other bias from the one or more control units 200, however, the biasing element 172 moves the sleeve 170 closed so that flow of fluid cannot pass through the internal ports 152 and out external ports 164 on the valve unit 160.

Eventually, as shown in FIG. 3B, when the one or more control units 200 are activated by the RFID tag (50), timer, or other method as discussed previously, force, pressure, or other counter bias from the one or more control units 200 applied in the chamber 162 through a channel 168 moves the sleeve 170 open relative to the internal ports 152. Passages, slots, or ports 174 in the sleeve 170 align the internal ports 152 with the external ports 164 so flow can pass out of the valve unit 160 and into the surrounding borehole annulus. (Although not explicitly shown, it will be appreciated that the internal port 152 of the flow port unit 150 can include features to resist erosion or corrosion caused by flow of treatment fluid.) To subsequently close the flow port unit 150, deactivation of the force, pressure, or counter bias from the one or more control units 200 allows the biasing element 172 to move the sleeve 170 closed so fluid can then be prevented from flowing out of the flow port unit 150.

The concentrically arranged sleeves 130 and 170 and mandrels 116 and 156 in FIGS. 2A-1 to 3B are used to facilitate assembly of the apparatus 100 and to accommodate the cylindrical arrangement and multiple ports 112 and 152. Although such an arrangement may be preferred, the apparatus 100 can have the valves 120 and 140 in different configurations, such as pistons or rods. In fact, each port 112 and 152 can have its own valve 130 and 170.

As noted above, the apparatus 100 may have one or more control units 200 for activating the packers 110*a-b* and flow port unit 150. In general, each of the components 110*a-b* and 150 can have its own control unit 200, or a single control unit 200 can be used for all of the components 110*a-b* and 150. Further still, the packers 110*a-b* may share a control unit 200, while the flow port unit 150 may have its own control unit 200.

Figure 4:
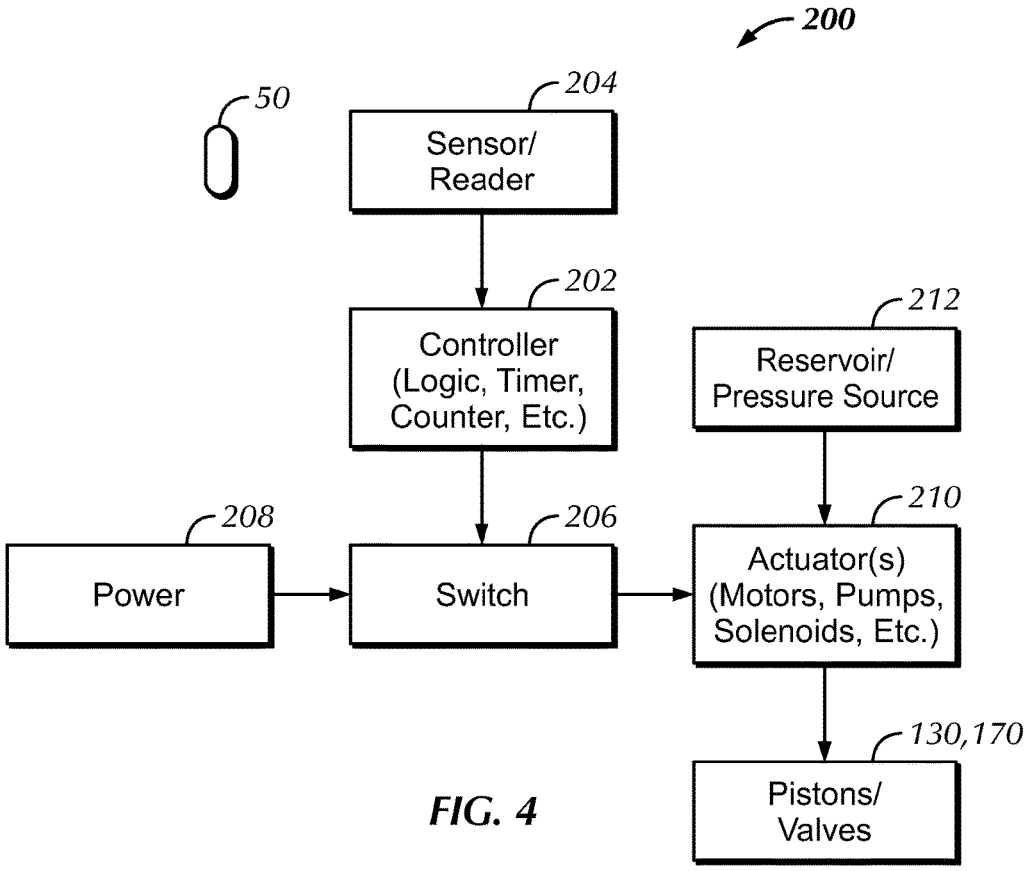
FIG. 4 schematically illustrates an electronic system having a controller for the disclosed straddle apparatus.

Either way, the one or more control units 200 can include components as schematically illustrated in FIG. 4. The control unit 200 includes a controller 202, which can include any suitable processor for a downhole tool. The controller 202 is operatively coupled to a sensor or reader 204 and to an actuator 206.

The type of sensor or reader 204 used depends on how commands are conveyed to the control unit 200 while deployed downhole. Various types of sensors, readers 202, or the like can be used, including, but not limited to, a radio frequency identification (RFID) reader, sensor, or antenna; a Hall Effect sensor; a pressure sensor; a telemetry sensor; a radioactive trace detector; a chemical detector; and the like. For example, the control unit 200 can be activated with any number of techniques—e.g., RFID tags in the flow stream may be used alone or with plugs; chemicals and/or radioactive tracers may be used in the flow stream; mud pressure pulses (if the system is closed chamber, e.g. cement bridges off in the annular area between the casing OD and borehole ID); mud pulses (if the system is actively flowing); etc.

As an alternative to RFID, for example, the control unit 200 can be configured to receive mud pulses from the surface or may include an electromagnetic (EM) or an acoustic telemetry system, which includes a receiver or a transceiver (not shown). An example of an EM telemetry system is discussed in U.S. Pat. No. 6,736,210, which is hereby incorporated by reference in its entirety.

For the purposes of the present disclosure, reference to the control unit 200 and the sensor 202 will be to an RFID based system, which may be preferred in some instances. As will be appreciated, the sensor 202 can be an RFID reader that uses radio waves to receive information (e.g., data and commands) from one or more electronic RFID tags 50, which can be attached to a plug or other object. The information is stored electronically, and the RFID tags 50 can be read at a distance from the reader 202. To convey the information to the apparatus 100 at a given time during operations, the RFID tags 50 are inserted into the tubing (20) at surface level and are carried downhole in the fluid stream. When the tags 50 come into proximity to the apparatus 100, the electronic reader 202 on the tool's control unit 200 interprets instructions embedded in the tags 50 to perform a required operation.

Logic of the controller 202 can count triggers, such as the passage of a particular RFID tag 50, a number of RFID tags 50, or the like. In addition and as an alternative, the logic of the controller 202 can use timers to actuate the actuators 206 after a period of time has passed since a detected trigger (e.g., after passage of an RFID tag 50 or after a previous operation is completed). These and other logical controls can be used by the controller 202.

When a particular instruction is detected, for example, the controller 202 operates a switch 206 or the like, to supply power from a power source 208 to one or more actuators 210, which can include one or more motors, pumps, solenoids, or other devices to provide force, pressure, or counter bias to the pistons, valves, or sleeves 130, 170 of the apparatus 100. The power source 208 can be a battery deployed downhole with the unit 200. The actuators 210 in the form of motors can be operatively coupled to the valves, pistons, or sleeves 130, 170 of the apparatus 100 with gears and the like. When activated, the motor actuators 210 can move the valves, pistons, or sleeves 130, 170 open and close as disclosed herein.

The actuators 210 in the form of pump(s) or solenoid(s) can be operatively coupled between pressure source(s) or reservoir(s) 212 and the valves, pistons, or sleeves 130, 170 of the apparatus 100. For example, the pressure source or reservoir 212 can be a reservoir of high pressure fluid. The solenoid actuators 210 can be activated by the power to open and allow the high pressure fluid to act on the valves, pistons, or sleeves 130, 170. Alternatively, the pressure source(s) or reservoir(s) 212 may be a reservoir of hydraulic fluid. The pump actuators 210 can be activated by the power to pump the hydraulic fluid of the source 212 to apply pressure against the valves, pistons, or sleeves 130, 170. Additionally, the pump actuators 210 can be operated in the reverse to relieve pressure against the valves, pistons, or sleeves 130, 170.

Figure 5A:
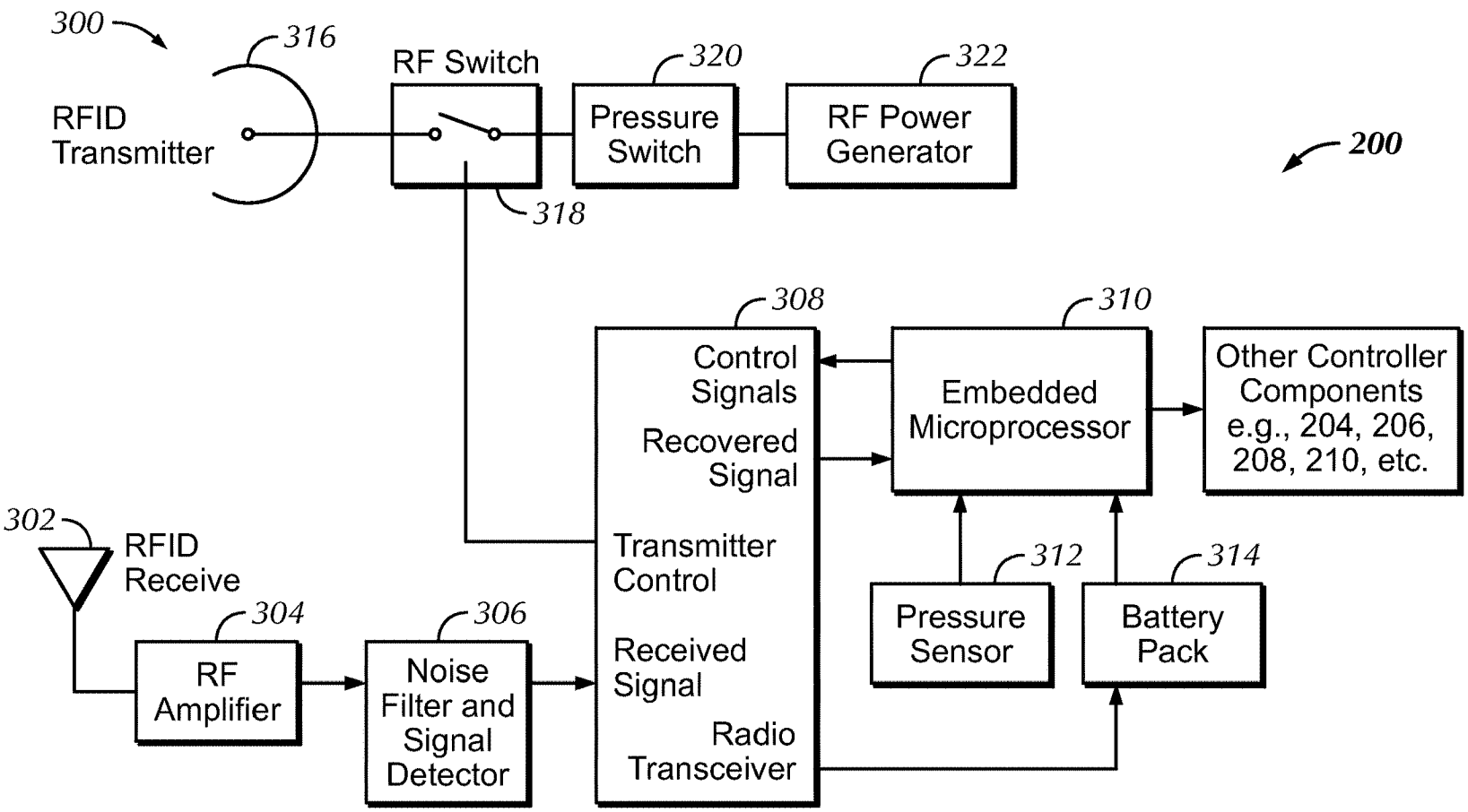
FIG. 5A illustrates an embodiment of a radio-frequency identification (RFID) electronics package for the disclosed controller.
Figure 5B:
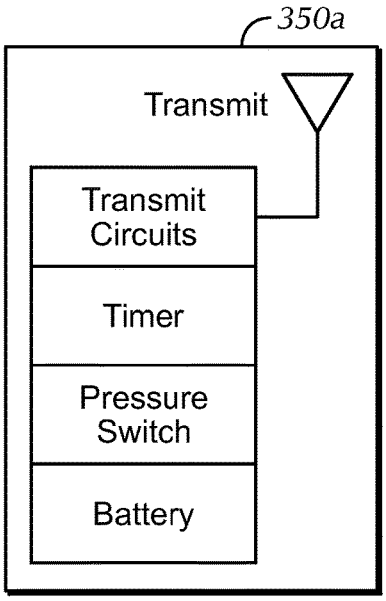
FIGS. 5B-5C illustrate an active RFID tag and a passive RFID tag, respectively.
Figure 5C:
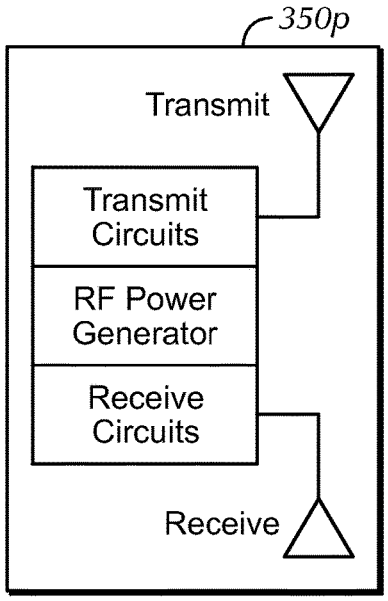

Further details of the control unit 200 are shown in FIG. 5A, which illustrates a radio-frequency identification (RFID) electronics package 300 for the control unit 200. In general, the electronics package 300 may communicate with an active RFID tag 350*a* (FIG. 5B) or a passive RFID tag 350*p* (FIG. 5C) depending on the implementation. Briefly, the active RFID tag 350*a* (FIG. 5B) includes a battery, pressure switch, timer, and transmit circuits. By contrast, the passive RFID tag 350*p* (FIG. 5C) includes receive circuits, RF power generator, and transmit circuits. In use, either of the RFID tags 350*a-p* may be individually encased and dropped or pumped through the tubing string as noted herein. Alternatively, either of the RFID tags 350*a-p* may be embedded in a ball (not shown) for seating in a ball seat of a tool, a plug, a bar, or some other device used to initiate action of a downhole tool.

The RFID electronics package 300 includes a receiver 302, an amplifier 304, a filter and detector 306, a transceiver 308, a microprocessor 310, a pressure sensor 312, a battery pack 314, a transmitter 316, an RF switch 318, a pressure switch 320, and an RF field generator 322. Some of these components (e.g., microprocessor 310 and battery 314) can be shared with the other components of the control unit 200 described herein.

If a passive tag 350*p* is used, the pressure switch 320 closes once the port apparatus 100 is deployed to a sufficient depth in the wellbore. The pressure switch 320 may remain open at the surface to prevent the electronics package 300 from becoming an ignition source. The microprocessor 310 may also detect deployment in the wellbore using the pressure sensor 312. Either way, the microprocessor 310 may delay activation of the transmitter 316 for a predetermined period of time to conserve the battery pack 314.

Once configured, the microprocessor 310 can begin transmitting a signal and listening for a response. Once a passive tag 350*p* is deployed into proximity of the transmitter 316, the passive tag 350*p* receives the transmitted signal, converts the signal to electricity, and transmits a response signal. In turn, the electronics package 300 receives the response signal via the antenna 302 and then amplifies, filters, demodulates, and analyzes the signal. If the signal matches a predetermined instruction signal, then the microprocessor 310 may activate an appropriate function on the apparatus 100, such as energizing a pump, starting a timer, etc. The instruction signal carried by the tag 350*a-p* may include an address of a tool (if the tool string includes multiple tools, packers, sleeves, valves, etc.), a set position (if the apparatus 100 is adjustable), a command or operation to perform, and other necessary information.

If an active RFID tag 350*a* is used, the transmission components 316-322 may be omitted from the electronics package 300. Instead, the active tag 350*a* can include its own battery, pressure switch, and timer so that the tag 350*a* may perform the function of the components 316-322.

Further, either of the tags 350*a-p* can include a memory unit (not shown) so that the microprocessor 310 can send a signal to the tag 350*a-p* and the tag 350*a-p* can record the data, which can then be read at the surface. In this way, the recorded data can confirm that a previous action has been carried out. The data written to the RFID tag 350*a-p* may include a date/time stamp, a set position (the command), a measured position (of control module position piston), and a tool address. The written RFID tag 350*a-p* may be circulated to the surface via the annulus.

Ultimately, once the microprocessor 310 detects one of the RFID tags 350*a-p* with the correct instruction signal, the microprocessor 310 can control operation of the other control unit components disclosed herein, such as discussed previously with reference to FIG. 4.

Figure 6:
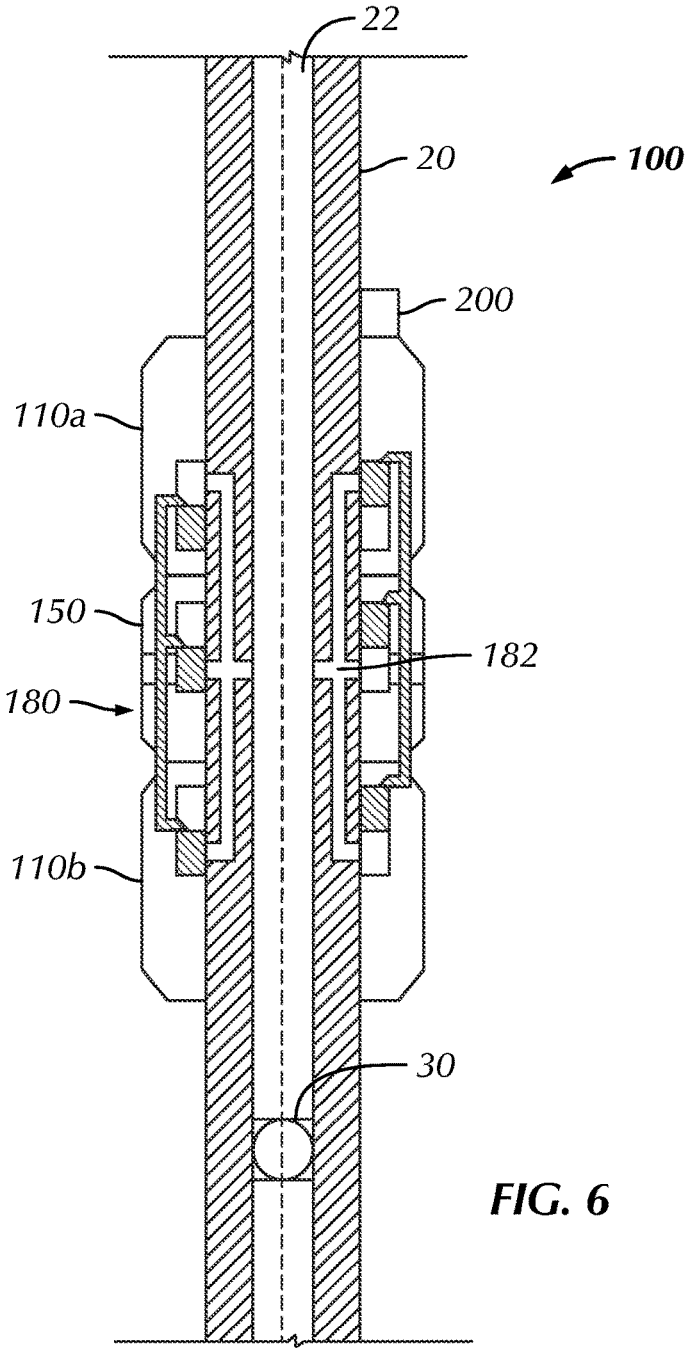
FIG. 6 schematically shows how the disclosed straddle apparatus can have integrated components.

Finally, FIG. 6 schematically shows how the disclosed apparatus 100 can have integrated components. As shown, the apparatus 100 has first and second packers 110*a-b* and a flow unit 150 disposed on the apparatus 100. The flow unit 150 is disposed between the first and second packers 110*a-b*, which can be inflatable or compression-set packers as disclosed herein. Overall, the apparatus 100 has at least one port 182, which is in fluid communication with the tubing 20 and which can be selectively communicated with the packers 110*a-b* and the flow unit 150.

In particular, at least one valve 180 placed in one condition (left side of FIG. 6) can communicate the tubing 20 with the packers 110*a-b* through the at least one port 182, while the flow unit 150 is closed. Alternatively, the at least one valve 180 placed in another condition (right side of FIG. 6) can communicate the tubing 20 with the borehole (not shown) through the at least one port 182, while the packers 110*a-b* are closed. To do this, the at least one valve 180 including the control unit 200 is electronically operable to open and close fluid communication between the tubing 20 and the first and second packers 110*a-b* or the borehole through the at least one port 182.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A straddle fluid treatment apparatus deployed in a borehole with tubing to treat sections of the borehole, the apparatus comprising:

first and second packers disposed on the apparatus and being operable to set and unset in a fluid treatment operation of each of the sections of the borehole;

a flow unit disposed on the apparatus between the first and second packers being operable to open and close off fluid communication between the tubing and the borehole;

an isolation valve disposed on the apparatus and being operable to open and close off fluid communication through the tubing; and at least one valve unit disposed on the apparatus and being operable to detect at least one activation, the at least one valve unit being electronically operable in response to the at least one detected activation to be open in a second consecutive step of the fluid treatment operation and then be closed in a third consecutive step fluid communication between the tubing and the first and second packers, the at least one valve unit being electronically operable in response to the at least one detected activation to be open in a fourth consecutive step and then be closed in a fifth consecutive step fluid communication between the tubing and the borehole through the flow unit;

an equalizing valve disposed on the apparatus and being operable to open and close fluid communication between first and second ports at first and second points on the apparatus, the first port being in communication with the borehole at the first point on the apparatus located between the first and second packers, the second port being in communication the borehole at the second point on the apparatus located outside the first and second packers, the equalizing valve being closed in at least the second, third, and fourth consecutive steps and being electronically operable in response to the at least one detected activation to open in a fifth consecutive step before reopening in a sixth consecutive step fluid communication between the tubing and the first and second packers, wherein the isolation valve in a first consecutive step of the fluid treatment operation is configured to close off communication of pumped fluid through the tubing, the pumped fluid closed off in the tubing setting the first and second packers with the fluid communication electronically operated by the at least one valve unit in at least the second consecutive step, the pumped fluid closed off in the tubing passing out the opened flow unit to the borehole with the fluid communication electronically operated by the at least one valve unit in at least the fourth consecutive step.

2. The apparatus of claim 1, wherein to treat a given one of the sections of the borehole, the isolation valve has a closed state in the first consecutive step of the fluid treatment operation to close off communication of the pumped fluid through the tubing, wherein to treat the given section of the borehole, the at least one valve unit is electronically operable in response to the at least one detected activation and comprises:

at least one packer valve having a first opened condition, in the second consecutive step of the fluid treatment operation, opening communication of the closed-off pumped fluid from the tubing to the first and second packers to set the first and second packers at the given section of the borehole and then having a first closed condition, in the third consecutive step, closing the communication from the tubing to the first and second packers to keep the first and second packers set; and at least one flow valve having a second opened condition, in the fourth consecutive step, opening communication of the closed-off pumped fluid from the tubing to the borehole through the flow unit to treat the given section of the borehole and then having a second closed condition, in the fifth consecutive step, closing the communication of the closed-off pumped fluid from the tubing to the borehole through the flow unit.

3. The apparatus of claim 2, wherein the at least one packer valve is in fluid communication between the tubing and at least one of the first and second packers, the at least one packer valve being biased to the first opened condition in at least the second consecutive step and being electronically operable in response to the at least one detected activation to the first closed condition in at least the third consecutive step, the at least one packer valve in the first opened condition permitting fluid communication between the tubing and the at least one packer, the at least one packer valve in the first closed condition preventing fluid communication therebetween.

4. The apparatus of claim 3, wherein the at least one packer valve comprises:

a sleeve disposed in the packer valve and biased to the first opened condition relative to at least one fill port in fluid communication with the tubing, the sleeve in the opened condition permitting fluid communication between the at least one fill port and the at least one packer; and an actuator in communication with the sleeve and being electronically operable in response to the at least one detected activation to move the sleeve to the first closed condition relative to the at least one fill port.

5. The apparatus of claim 4, wherein the at least one packer comprises an inflatable packer element being inflatable with fluid pressure communicated from the at least one fill port.

6. The apparatus of claim 4, wherein the at least one packer comprises a compressible packer element being compressible with fluid pressure communicated from the at least one fill port.

7. The apparatus of claim 4, wherein the actuator comprise a pump operable to pump fluid pressure against the bias of the sleeve.

8. The apparatus of claim 4, wherein the sleeve comprises a biasing member biasing the sleeve to the opened condition.

9. The apparatus of claim 2, wherein the at least one flow valve is in fluid communication between the tubing and the borehole, the at least one flow valve being biased to the second closed condition in at least the second consecutive step and being electronically operable in response to the at least one detected activation to the second opened condition in at least the fourth consecutive step, the at least one flow valve in the second opened condition permitting fluid communication between the tubing and the borehole, the at least one flow valve in the second closed condition preventing fluid communication therebetween.

10. The apparatus of claim 9, wherein the at least one flow valve is electronically operable to the second open condition after a preset time past the at least one detected activation.

11. The apparatus of claim 9, wherein the at least one flow valve comprises:

a sleeve disposed in the flow valve and biased to the second closed condition relative to at least one flow port in fluid communication with the tubing, the sleeve in the second closed condition preventing fluid communication between the at least one flow port and the borehole; and an actuator in communication with the sleeve and being electronically operable in response to the at least one detected activation to move the sleeve to the second opened condition relative to the at least one flow port.

12. The apparatus of claim 11, wherein the actuator comprise a pump operable to pump fluid pressure relative to the bias of the sleeve.

13. The apparatus of claim 11, wherein the sleeve comprises a biasing member biasing the sleeve to the second closed condition.

14. The apparatus of claim 13, wherein the biasing member comprises a spring.

15. The apparatus of claim 11, wherein the sleeve comprises at least one slot moving between a misaligned condition and an aligned condition with respect to the at least one flow port with the movement of the sleeve between the second closed position and the second opened position.

16. The apparatus of claim 2, wherein the apparatus comprises:

at least one fill port in fluid communication with the tubing, wherein the at least one packer valve is biased to open fluid communication between the at least one fill port and the first and second packers and is operable to close the fluid communication between the at least one fill port and the first and second packers; and at least one flow port in fluid communication with the tubing, wherein the at least one flow valve is biased to close fluid communication between the flow port and the borehole and is operable to open the fluid communication between the flow port and the borehole;

wherein the at least one valve unit comprises one or more control units operatively coupled to the at least one packer valve and the at least one flow valve and being operable to detect the at least one activation, the one or more control units electronically activating the at least one packer valve in response to the at least one detected activation to be open in the second consecutive step of the fluid treatment operation and then be closed in the third consecutive step the communication between the first and second packers and the at least one fill port, the one or more control units electronically activating the at least one flow valve in response to the at least one detected activation to be open in the fourth consecutive step and then be closed in the fifth consecutive step the communication between the flow port and the borehole.

17. The apparatus of claim 1, wherein the at least one valve unit comprises:

a reader detecting a radio frequency identification tag as the at least one detected activation; and an actuator operatively coupled to the reader and actuating the at least one valve unit in response to the detection of the radio frequency identification tag.

18. The apparatus of claim 17, wherein actuator comprise a pump operable to pump fluid pressure relative to bias of the at least one valve unit.

19. The apparatus of claim 1, wherein the at least one valve unit comprises a sensor responsive to a signal as the at least one detected activation.

20. The apparatus of claim 19, wherein the sensor comprises a reader responsive to passage of at least one radio frequency identification tag.

21. A method of treating sections of a borehole, the method comprising:

deploying an apparatus on tubing to each of the sections of the borehole, the apparatus comprising an equalizing valve disposed on the apparatus and being operable to open and close fluid communication between first and second ports at first and second points on the apparatus, the first port being in communication with the borehole at the first point on the apparatus located between the first and second packers, the second port being in communication the borehole at the second point on the apparatus located outside the first and second packers;

treating each section with a fluid treatment operation by:

detecting at least one activation for the fluid treatment operation;

closing off communication of pumped fluid through the tubing by closing an isolation valve on the apparatus in a first consecutive step of the fluid treatment operation;

setting first and second packers of the apparatus against the borehole in a second consecutive step by pumping fluid pressure of the pumped fluid down the tubing and through at least one packer valve opened uphole of the closed isolation valve on the apparatus;

trapping the fluid pressure in the first and second packers by electronically closing the at least one packer valve in a third consecutive step;

electronically opening at least one flow valve disposed on the apparatus between the first and second packers in a fourth consecutive step;

pumping treatment of the pumped fluid from the tubing to the section of the borehole through the open flow valve uphole of the closed isolation valve; and keeping the equalizing valve closed in at least the second, third, and fourth consecutive steps and electronically opening the equalizing valve in response to the at least one detected activation in a fifth consecutive step before reopening in a sixth consecutive step fluid communication between the tubing and the first and second packers.

22. The method of claim 21, wherein electronically closing the at least one packer valve comprises detecting the at least one activation and electronically initiating the closing of the at least one packer valve in response to the at least one detected activation.

23. The method of claim 21, wherein detecting the at least one activation comprises detecting passage of a radio frequency identification tag relative to at least one radio frequency identification reader on the apparatus.

24. The method of claim 23, wherein electronically initiating the closing of the at least one packer valve further comprises initiating after a period of time past the detected passage of the radio frequency identification tag.

25. The method of claim 23, wherein electronically opening the at least one flow valve disposed on the apparatus between the first and second packers comprises initiating the opening of the at least one flow valve after a period of time past the detected passage of the radio frequency identification tag.

26. The method of claim 21, further comprising electronically closing the at least one flow valve in the fifth consecutive step.

27. The method of claim 26, further comprising unsetting the first and second packers by electronically opening the at least one packer valve in the sixth consecutive step.

28. The method of claim 27, further comprising deploying the apparatus on the tubing to another of the sections of the borehole.

29. The method of claim 26, further comprising opening fluid communication through the tubing by opening the isolation valve disposed on the tubing.

30. The method of claim 21, wherein electronically closing the at least one flow valve comprises detecting the at least one activation and electronically initiating the closing of the at least one flow valve in response to the at least one detected activation.

31. The method of claim 30, wherein electronically initiating the closing of the at least one flow valve in response to the at least one detected activation comprises detecting passage of a radio frequency identification tag relative to at least one radio frequency identification reader on the apparatus.

32. The method of claim 30, wherein electronically initiating the closing of the at least one flow valve further comprises initiating after a period of time past the at least one detected activation.

* * * * *